US007586262B2

(12) United States Patent
Chang et al.

(10) Patent No.: US 7,586,262 B2
(45) Date of Patent: Sep. 8, 2009

(54) FLAT FLUORESCENT LAMP AND LIQUID CRYSTAL DISPLAY

(75) Inventors: Chao-Jen Chang, Taoyuan County (TW); Chia-Hua Ai, Tainan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 560 days.

(21) Appl. No.: 11/532,105

(22) Filed: Sep. 15, 2006

(65) Prior Publication Data

US 2008/0067937 A1 Mar. 20, 2008

(51) Int. Cl.
*H01J 17/00* (2006.01)
*H01J 61/00* (2006.01)

(52) U.S. Cl. ..... 313/581; 313/483; 313/484; 313/634

(58) Field of Classification Search ..... 313/581–587, 313/634, 483, 482
See application file for complete search history.

(56) References Cited

U.S. PATENT DOCUMENTS 6,252,352 B1 * 6/2001 Vollkommer et al. ..... 313/483
6,486,611 B2 11/2002 Tokunaga et al.
7,471,037 B2 * 12/2008 Park et al. ..... 313/493
2002/0017857 A1 * 2/2002 Hashimoto et al. ..... 313/496
2002/0105260 A1 8/2002 Lee
2003/0137237 A1 * 7/2003 Kim et al. ..... 313/495
2004/0150317 A1 * 8/2004 Kim et al. ..... 313/491
2004/0189199 A1 9/2004 Komaki et al.

FOREIGN PATENT DOCUMENTS

JP 11-149873 6/1999
TW 392187 6/2000
TW 514949 12/2002
TW 521292 2/2003

* cited by examiner

*Primary Examiner*—Mariceli Santiago
(74) *Attorney, Agent, or Firm*—Jianq Chyun IP Office

(57) ABSTRACT

A flat fluorescent lamp (FFL) is provided. Strip electrodes of the FFL include a plurality of electrode branches, and a plurality of dielectric branches is arranged around the electrode branches, so as to increase the coating area of the fluorescent material. The distribution position of the fluorescent material may be adjusted by the dielectric branches, thus enhancing the brightness of the FFL and improving the uniformity of the output light. The present invention further provides a liquid crystal display which utilizes the FFL as a backlight source for achieving a better display effect.

22 Claims, 6 Drawing Sheets

100

FLAT FLUORESCENT LAMP AND LIQUID CRYSTAL DISPLAY

BACKGROUND OF THE INVENTION

1. Field of Invention

The present invention relates to a light source module and a display apparatus. More particularly, the present invention relates to a flat fluorescent lamp (FFL) with high luminous efficiency and a liquid crystal display (LCD) using the same.

2. Description of Related Art

Along with the progress in modern video technology, LCDs have been greatly used in display screens of consumable electronic products such as mobile phones, notebooks, personal computers and personal digital assistants (PDAs). However, as the liquid crystal panel of an LCD itself cannot emit light, a backlight module disposed under the liquid crystal panel is required to provide the display light source desired by the liquid crystal panel. Recently, the backlight modules on the market are mainly FFLs, cold cathode fluorescent lamps (CCFLs) and light emitting diodes (LEDs), wherein the FFLs are widely used in LCDs due to the advantages of being low in cost, taking up a small space and so on.

FIG. 1 is a partial sectional view of a conventional FFL, and FIG. 2 is a top view of the FFL. In order to make the figure clear, a part of the means in FIG. 1 is not shown in FIG. 2. Referring to FIG. 1 and FIG. 2, a conventional FFL 100 forms a plurality of discharge spaces 132 between an upper substrate 120 and a lower substrate 110 via spacers 130, wherein a discharge gas 140 is filled into the discharge spaces 132. Moreover, an electrode set 150 is disposed on the lower substrate 110 in each of the discharge spaces 132. The electrode set 150 comprises a first strip electrode 152 and a second strip electrode 154 (the electrodes 152, 154 are either anode or cathode). A dielectric layer 160 lies on the electrode set 150 to protect the electrode set 150. Moreover, a fluorescent material 170 is coated on the outer walls of the upper substrate 120 and the dielectric layer 160.

When a driving voltage is applied to the electrode set 150, an electric field is formed between the first strip electrode 152 and the second strip electrode 154, for dissociating the discharge gas 140 into plasma. Then, the electrons in an excited state in each ion in the plasma may emit UV light when returning to a ground state, and when the UV light emitted by the plasma irradiates the fluorescent material 170, the fluorescent material 170 is excited to emit light.

It should be noted that conventionally to enhance the effect of the electric field to the discharge gas 140, a plurality of electrode branches 152*a* is generally formed on both sides of the first strip electrode 152, so as to form a main triangular discharge area 156 with the opposite second strip electrode 154 via the point discharge of the electrode branches 152*a*. However, in practice, the brightness of the discharge area 156 is usually quite different from that of other areas except the discharge area 156, thus affecting the uniformity of the whole surface light source. According to the practical situation, when the brightness of the top ends of the electrode branches 152*a* reaches 10000 nit, the brightness of other areas only reaches 6000 nit, and when the brightness of the top ends of the electrode branches 152*a* reaches 7000 nit, the brightness of other areas only reaches 4000 nit.

SUMMARY OF THE INVENTION

Accordingly, an objective of the present invention is to provide an FFL which has a better luminous efficiency and may output a uniform surface light source.

Another objective of the present invention is to provide an LCD, which achieves a better display effect via the above-mentioned FFL.

In order to achieve the above or other objectives, the present invention provides an FFL, which comprises a first substrate, a plurality of electrode sets, a patterned dielectric layer, a plurality of dielectric branches, a second substrate, a plurality of spacers, a fluorescent material and a discharge gas. The electrode sets are disposed on the first substrate, and each electrode set at least comprises a first strip electrode and a second strip electrode parallel to each other, wherein the side edge of the first strip electrode has a plurality of electrode branches extending towards the second strip electrode. Moreover, the patterned dielectric layer and the dielectric branches are disposed on the first substrate, wherein the patterned dielectric layer covers the electrode sets, and the dielectric branches are disposed around the electrode branches. Further, the second substrate is disposed opposite to the first substrate, and the spacers connect the first substrate and the second substrate, so as to form a plurality of discharge spaces between the first substrate and the second substrate. Each of the discharge spaces has an electrode set, and the fluorescent material and the discharge gas are disposed in the discharge spaces.

In an embodiment of the present invention, the dielectric branches adjoin the patterned dielectric layer above the first strip electrodes or adjoin the patterned dielectric layer above the second strip electrodes.

In the embodiment of the present invention, the dielectric branches on both sides of each electrode branch are parallel to each other.

In the embodiment of the present invention, a plurality of discharge areas is formed between the electrode branches of each first strip electrode and the opposite second strip electrode, and the dielectric branches are disposed along the edges of the discharge areas.

In the embodiment of the present invention, a part of the fluorescent material is distributed on both side walls of each dielectric branch, wherein one side of each dielectric branch far away from the electrode branch acquires more fluorescent material than the other side close to the electrode branch.

In the embodiment of the present invention, the patterned dielectric layer above each second strip electrode has a plurality of recesses, wherein the recesses in each discharge space are opposite to the electrode branches, and each recess is disposed between two adjacent dielectric branches. Moreover, another part of the fluorescent material is distributed in the recesses, and between the patterned dielectric layer above each second strip electrode and the adjacent spacer.

In the embodiment of the present invention, the above-mentioned FFL further comprises a reflecting layer, which is disposed above the first substrate and under the electrode sets.

The present invention further provides an LCD mainly formed by the above-mentioned FFL and a liquid crystal panel, wherein the FFL is disposed beside the liquid crystal panel for providing the backlight source required by the liquid crystal panel.

In view of the above, in the present invention, a plurality of dielectric branches is formed around the electrode branches, for increasing the coating area of the fluorescent material and adjusting the distribution position of the fluorescent material, so as to enhance the brightness of the FFL and improve the uniformity of the output light. Thus, the LCD achieves a better display effect.

In order to make the aforementioned and other objectives, features and advantages of the present invention comprehensible, preferred embodiments accompanied with drawings are described in detail below.

DESCRIPTION OF EMBODIMENTS

The present invention can be applied to various FFLs, for solving the problem of non-uniformity of the output light due to the point discharge of the electrode branches. Recently, in a common FFL, the arrangements of the electrode sets are different, for example, each discharge space only has a pair of first strip electrode and second strip electrode, or has a plurality of interlaced first strip electrodes and second strip electrodes. Moreover, the shape of the electrode branch is various, such as square, circular and triangle. One of the above arrangements and shapes are illustrated as an example in the following embodiments, but they are not intended to limit the application scope of the present invention. The existing FFLs all can adopt the design of the dielectric branches provided by the present invention to improve the uniformity of the output light, or to further enhance the luminous efficacy of the output light.

Figure 1:
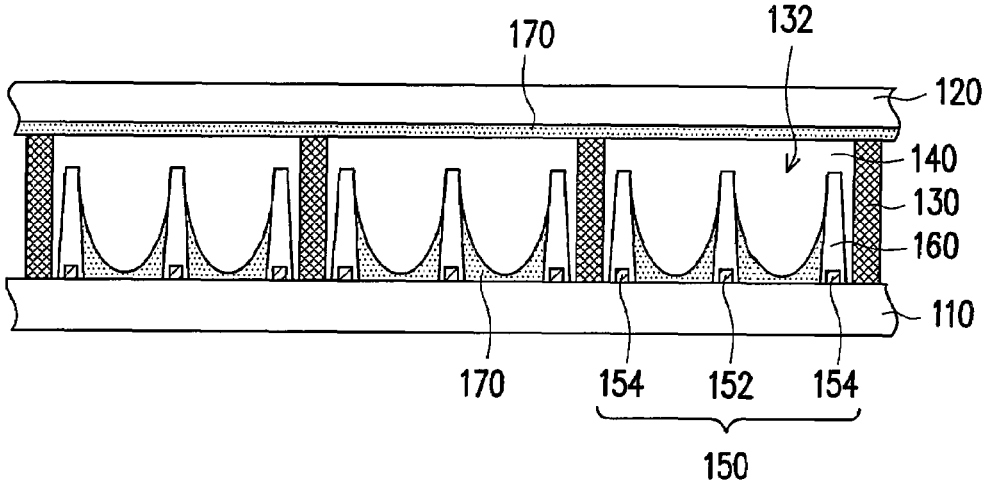
FIG. 1 (PRIOR ART)
FIG. 1 is a partial sectional view of a conventional FFL.
Figure 2:
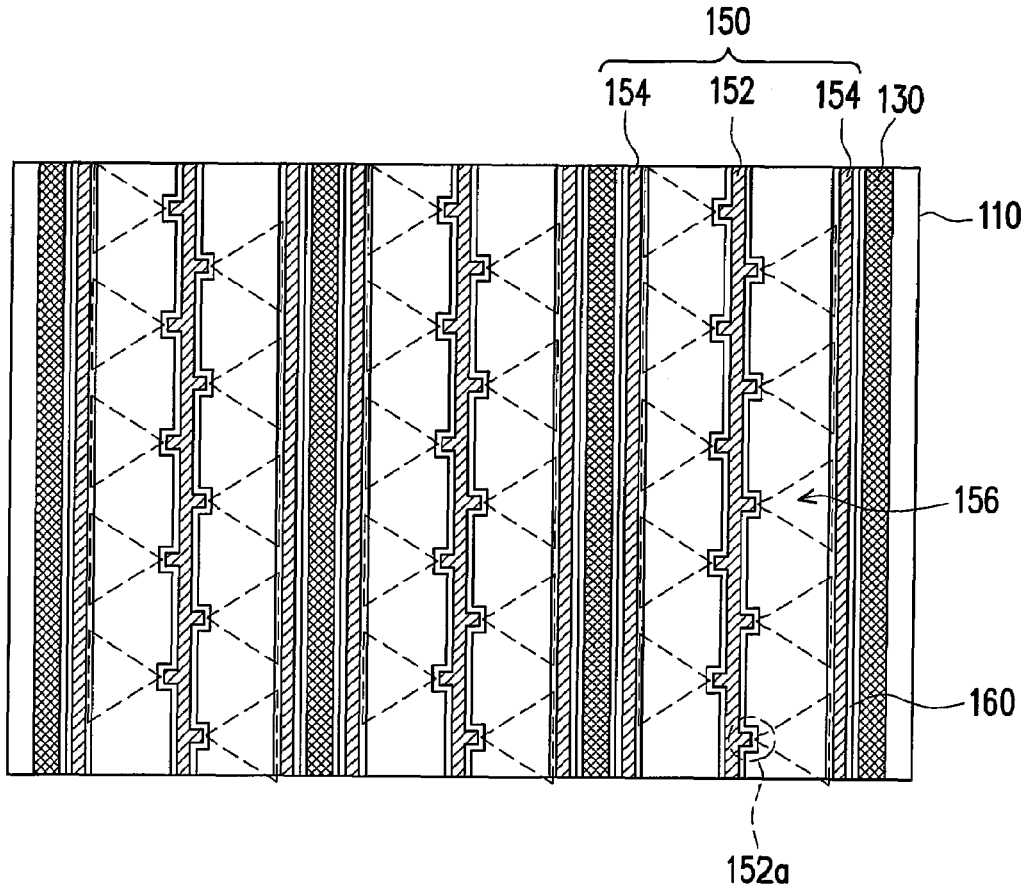
FIG. 2 (PRIOR ART)
FIG. 2 is a top view of the FFL in FIG. 1.
Figure 3:
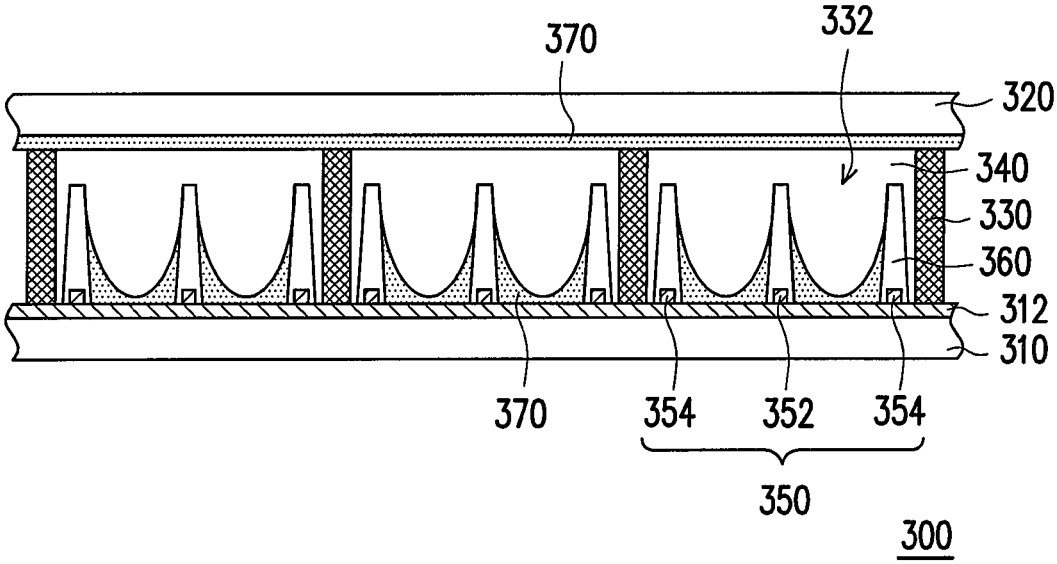
FIG. 3 is a partial sectional view of an FFL according to a preferred embodiment of the present invention.

FIG. 3 is a partial sectional view of an FFL according to a preferred embodiment of the present invention. As shown in FIG. 3, an FFL 300 comprises a first substrate 310, a second substrate 320, a plurality of spacers 330, a discharge gas 340, a plurality of electrode sets 350, a patterned dielectric layer 360 and a fluorescent material 370. The first substrate 310 is disposed opposite to the second substrate 320, and the spacers 330 are connected between the first substrate 310 and the second substrate 320, so as to form a plurality of discharge spaces 332 between the first substrate 310 and the second substrate.

Referring to FIG. 3, the discharge gas 340, for example, an inert gas such as xenon, neon or argon, is filled in the discharge space 332. The electrode set 350 is disposed on the first substrate 310, wherein each electrode set 350 comprises an interlaced first strip electrode 352 and second strip electrode 354, for being an anode and a cathode respectively. Moreover, the patterned dielectric layer 360 covers the electrode set 350, so as to protect the electrode set 350 from being directly bombarded by the plasma ion. Moreover, the fluorescent material 370 is, for example, coated on the outer walls of the second substrate 320 and the dielectric layer 360. A reflecting layer 312, for example, made of metal is further formed on the first substrate 310 and under the electrode set 350, for increasing the luminous efficiency. When a driving voltage is applied to the electrode set 350, an electric field can be generated between the first strip electrode 352 and the second strip electrode 354, for dissociating the discharge gas 340 into plasma. After that, the electrons in an excited state in each ion in the plasma may emit UV light when returning to a ground state, and when the UV light emitted by the plasma irradiates the fluorescent material 370, the fluorescent material 370 is excited to emit light.

Figure 4A:
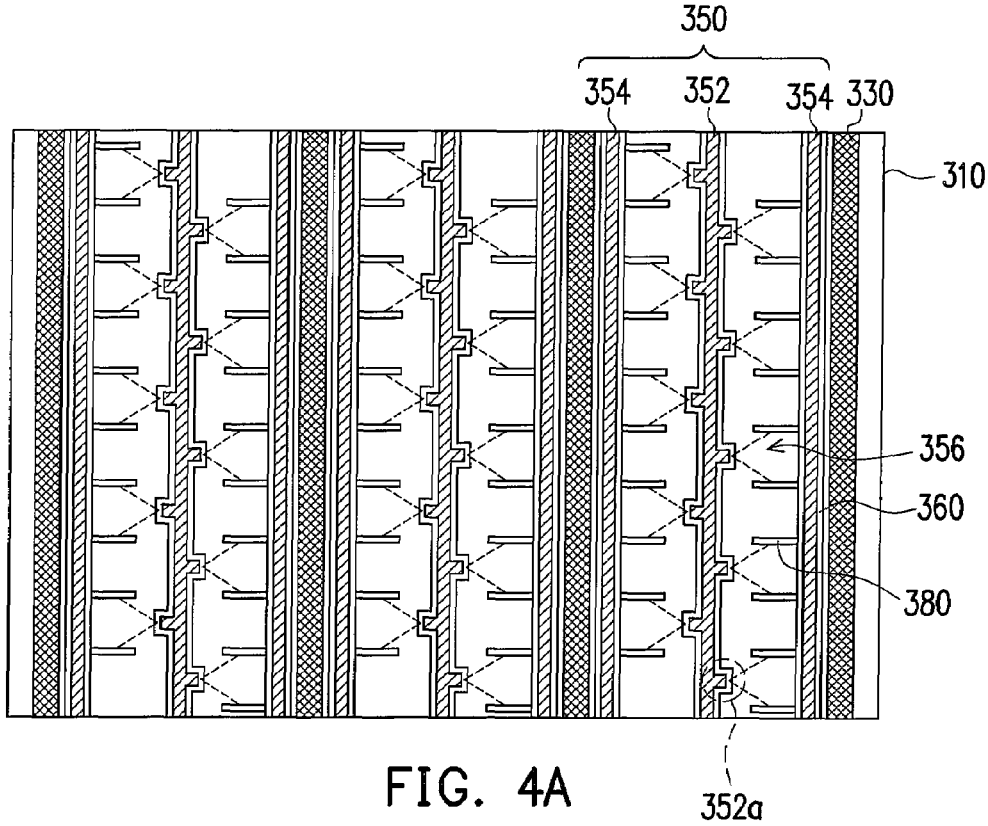
FIG. 4A is a top view of the FFL in FIG. 3.
Figure 4B:
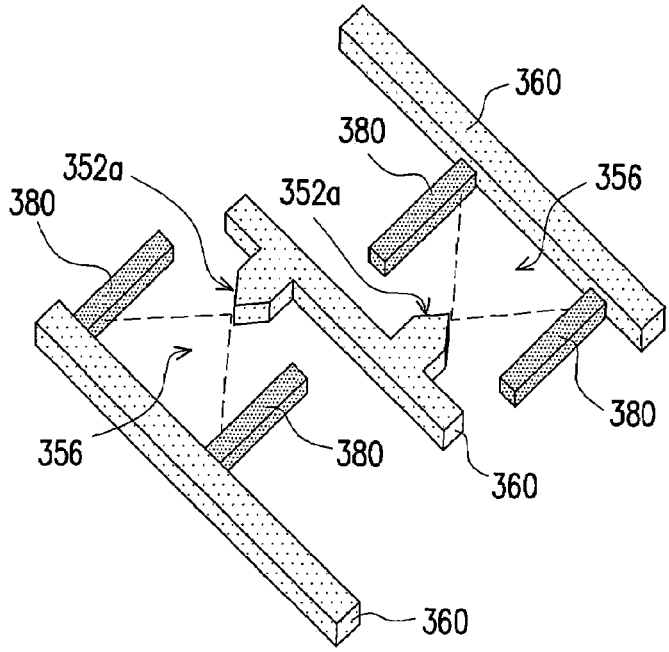
FIG. 4B is a schematic partial view of the structures of the dielectric layer and the electrode in FIG. 3.

FIG. 4A is a top view of the FFL 300, and FIG. 4B is a schematic partial view of the structures of the dielectric layer and the electrode according to the present embodiment. In order to make the figure clear, the second substrate 320, discharge gas 340, fluorescent material 370 and other means in FIG. 3 are not shown in FIG. 4A. Referring to FIG. 4A and FIG. 4B, a plurality of electrode branches 352*a* extending towards the second strip electrodes 354 is formed on both sides of the first strip electrode 352, and a plurality of discharge areas 356 is formed between the electrode branches 352*a* and the opposite second strip electrodes 354 due to the point discharge of the electrode branches 352*a*.

In the present embodiment, in order to improve the brightness and the luminous efficiency of the FFL 300, a dielectric branch 380 is disposed respectively on both sides of the electrode branch 352*a*. The dielectric branch 380, for example, adjoins the patterned dielectric layer 360 above the second strip electrode 354, and the dielectric branches 380 on both sides of each electrode branch 352*a* are parallel to each other, wherein a preferred scope of the height of the dielectric branches 380 is smaller than or equal to the thickness of the patterned dielectric layer 360. Moreover, the dielectric branch 380 is, for example, fabricated by lamination printing with screen mask.

As the dielectric branches 380 are disposed on the both sides of the electrode branch 352*a*, the coating area of the fluorescent material 370 is increased (for example, the side wall of the dielectric branches 380). In the present invention, the coating manners of the fluorescent material 370 are various, for example, the fluorescent material 370 can be uniformly distributed on both side walls of each dielectric branch 380 for increasing the coating area of the whole fluorescent material 370, thus enhancing the luminous efficiency. Moreover, as the discharge area 356 has a high discharge efficiency, one side of each dielectric branch 380 far away from the electrode branch 352*a* may acquire more fluorescent material 370 than the other side close to the electrode branch 352*a*, so as to compensate the discharge efficiency, thereby improving the uniformity of the whole surface light source.

The following table is the relation after comparing the brightness of the FFL of the present invention and a conventional FFL in practical operation, wherein the dimension of the dielectric branch adopted by the present invention is 3500×500×140 μm, and the thickness of the fluorescent material is 70 μm. It is known from the following table that the overall brightness of the FFL of the present invention is apparently higher than that of the conventional art.

| | Brightness of Discharge Area | Brightness of Other Areas | Overall Brightness |
|---|---|---|---|
| Conventional Structure | 12470 nit | 9105 nit | 10596 nit |
| Structure of Present | 15022 nit | 10188 nit | 12393 nit |

-continued

| | Brightness of Discharge Area | Brightness of Other Areas | Overall Brightness |
|---|---|---|---|
| Invention Rate of Improvement | above 20.5% | above 11.9% | above 17% |

In the above embodiment, the dielectric branch adjoins the patterned dielectric layer opposite to the electrode branch. Besides, in other embodiments of the present invention, the dielectric branch, for example, adjoins the patterned dielectric layer on the same side as the electrode branch (i.e. above the first strip electrode), or is disposed at any appropriate position around the electrode branch. Moreover, the dielectric branches on both sides of the electrode branch can not only be disposed in parallel, but also, for example, disposed along the edges of the discharge areas, for achieving a better luminous efficiency.

Figure 5A:
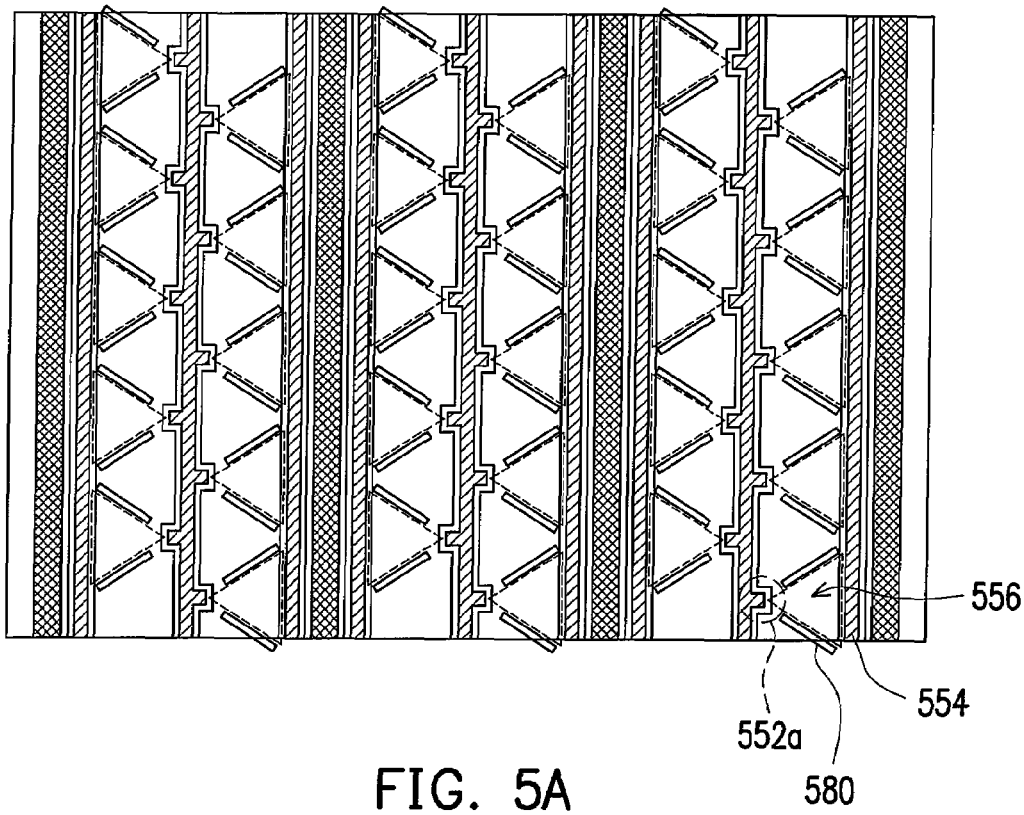
FIG. 5A is a top view of another FFL of the present invention.
Figure 5B:
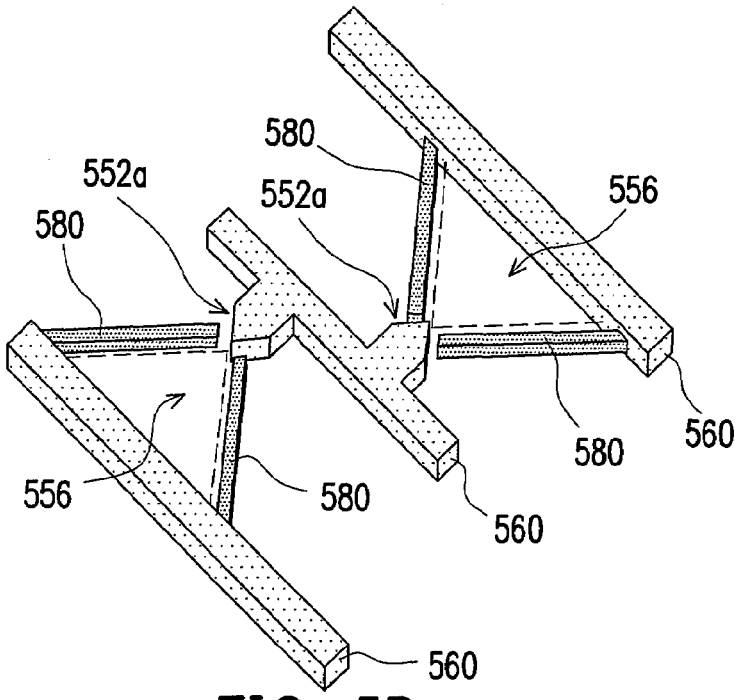
FIG. 5B is a schematic partial view of the structures of the dielectric layer and the electrode in FIG. 5A.

FIG. 5A is a top view of another FFL of the present invention, and FIG. 5B is a schematic partial view of the structures of the dielectric layer and the electrode of the present embodiment. In order to make the figure clear, only a part of the means are shown in FIGS. 5A and 5B, and the complete structure can be seen in FIG. 3 with reference to the related descriptions. In the present embodiment, a dielectric branch 580 is disposed along a discharge area 556 between an electrode branch 552*a* and a second strip electrode 554, wherein similarly, a preferred scope of the thickness of the dielectric branch 580 is smaller than that of a patterned dielectric layer 560. Besides, the dielectric branch 580 can also be fabricated by lamination printing with screen mask.

As the dielectric branch 580 of the present embodiment is disposed along the edge of the discharge area 556, the discharge area 556 can be used effectively, such that the fluorescent material (not shown) on the side wall of the dielectric branch 580 adjacent to the discharge area 556 can fully react, so as to enhance the brightness of the output light. Moreover, the present embodiment can also modify the coating amount of the fluorescent material on both side walls of the dielectric branch 580 for adjusting the luminous effect, which will not be described in detail herein.

In addition to the above embodiments, the present invention can further enhance the luminous efficiency of the FFL. Referring to the above embodiments, when a driving voltage is applied to the electrode set, the dissociated plasma is generated between the first strip electrode and the second strip electrode, so the main light-emitting area of the FFL is located between the first strip electrode and the second strip electrode. In other words, as it is not easy to form an electric field between the spacer and the adjacent strip electrode, a dark area is formed. In order to solve the above problem, in the present invention, the conventional structure of the patterned dielectric layer can be designed to increase the operating area of the electric field in the discharge space, so as to improve the brightness of the FFL. The embodiment for illustration is as follows.

Figure 6:
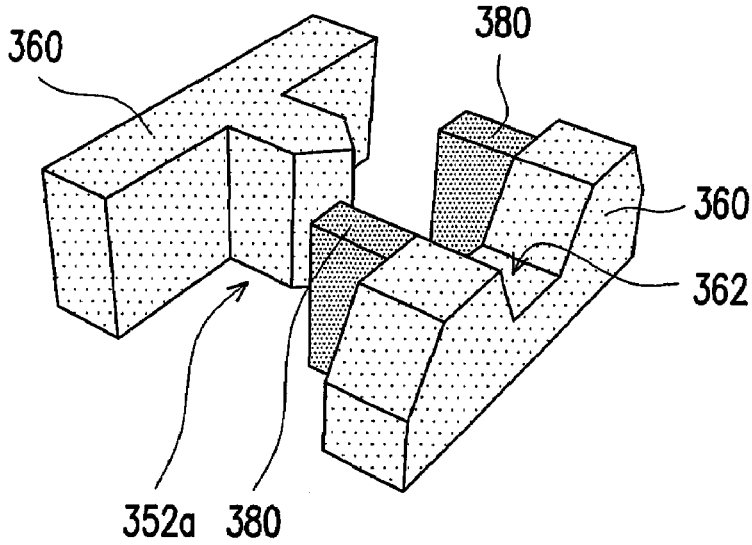
FIG. 6 is a schematic partial view of the structures of the dielectric layer and the electrode according to another embodiment of the present invention.
Figure 7:
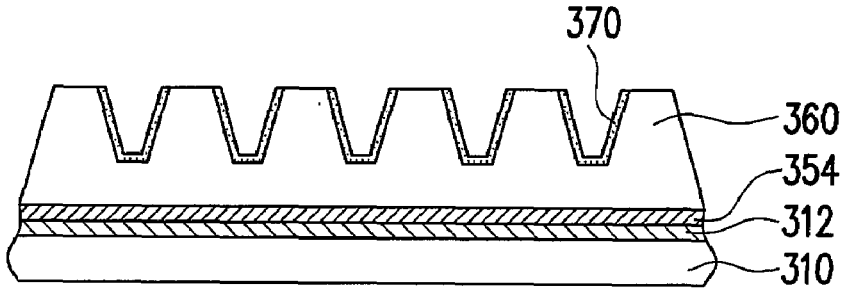
FIGS. 7 and 8 are respectively sectional views of the dielectric layer and the electrode of FIG. 6 at different positions.
Figure 8:
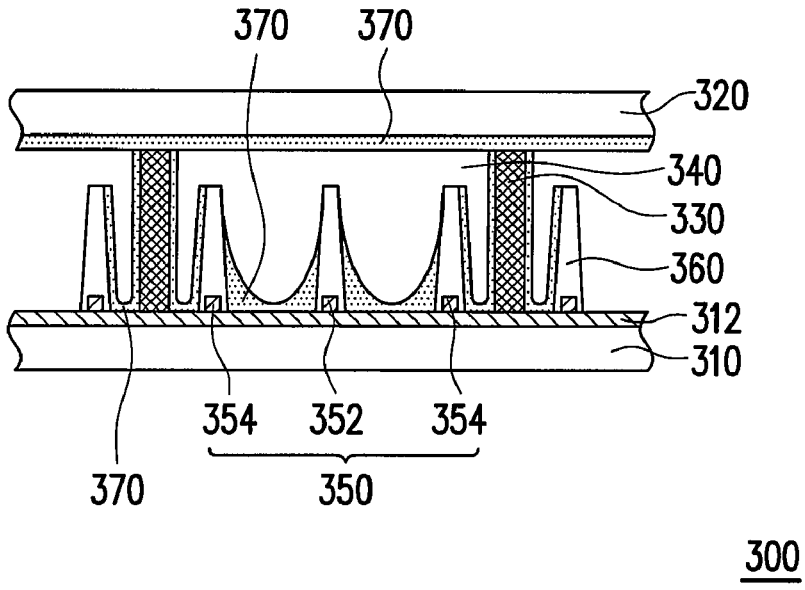

FIG. 6 is a schematic partial view of the structures of the dielectric layer and the electrode according to another embodiment of the present invention, and FIG. 7 and FIG. 8 are respectively sectional views of the dielectric layer and the electrode at different positions. The present embodiment varies based on the structure of the FFL as shown in FIGS. 4A and 4B, so FIGS. 6~8 adopt the same numerals as those of the FIGS. 4A and 4B to indicate the similar elements, and the descriptions of the related elements can refer to the above embodiments, which will not be described in detail herein. As shown in FIG. 6, in the structures of the dielectric layer and the electrode of the present invention, a plurality of dielectric branches 380 is fabricated on the side surface of the patterned dielectric layer 360 above the second strip electrode 354 (referring to FIG. 4A), and in addition, a plurality of recesses 362 is formed on the patterned dielectric layer 360. The recesses 362 are, for example, opposite to the electrode branch 352*a* on the first strip electrode 352, and disposed between two adjacent dielectric branches 380. As the patterned dielectric layer 360 has the recesses 362 disposed thereon, in the present embodiment, as shown in FIG. 7, the fluorescent material 370 is coated in the recesses 362 to increase the coating area of the fluorescent material 370, thereby enhancing the whole luminous efficiency of the FFL.

Moreover, when discharging occurs between the electrode branch 352*a* and the opposite second strip electrode 354, the generated electric field may affect the non-emitting areas between the spacer 330 and the adjacent second strip electrode 354 via the recesses 362. Therefore, the present embodiment may be as shown in FIG. 8, wherein the fluorescent material 370 is coated on the areas between the spacer 330 and the patterned dielectric layer above the adjacent second strip electrode 354, or the fluorescent material 370 originally coated on the position may be affected by the dissociated plasma to emit light. In other words, the design of forming the recesses 362 on the patterned dielectric layer 360 of the present embodiment not only increases the coating area of the fluorescent material 370, but also enables areas that do not emit light originally to emit light by being affected by the electric field. Therefore, the luminous efficiency of the FFL is further enhanced.

Figure 9:
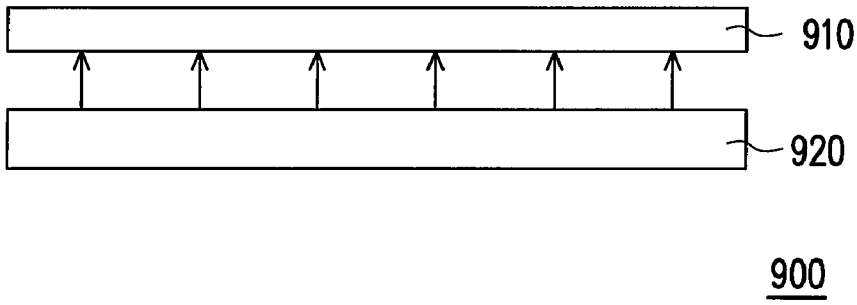
FIG. 9 is a schematic view of the LCD of the present invention.

The present invention further provides an LCD which utilizes the above-mentioned FFL. FIG. 9 is a schematic view of the LCD of the present invention, wherein an LCD 900 mainly comprises a liquid crystal panel 910 and an FFL 920. In the present embodiment, the FFL 920 may be one of the various FFLs provided by the present invention, and the liquid crystal panel 910 is disposed above the FFL 920, for using the surface light source provided by the FFL 920 as the display light source.

To sum up, in the FFL and LCD of the present invention, a plurality of dielectric branches is formed around the electrode branches, so as to increase the coating area of the fluorescent material to improve the luminous efficiency of the FFL, thereby enhancing the display brightness of the LCD. Moreover, in the present invention, the distribution position of the fluorescent material is adjusted by the dielectric branches for compensating the discharge efficiency in different areas, so as to improve the uniformity of the whole surface light source, and make the LCD achieve a better display effect.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A flat fluorescent lamp (FFL), comprising:

a first substrate;

a plurality of electrode sets, disposed on the first substrate, wherein each electrode set comprises at least a first strip electrode and a second strip electrode parallel to each other, and the side edge of the first strip electrode has a plurality of electrode branches extending towards the second strip electrode;

a patterned dielectric layer, disposed on the first substrate and covering the electrode sets;

a plurality of dielectric branches, disposed on the first substrate, and located around the electrode branches;

a second substrate, disposed opposite to the first substrate;

a plurality of spacers, connecting the first substrate and the second substrate, for forming a plurality of discharge spaces between the first substrate and the second substrate, wherein the electrode sets are respectively disposed in the discharge spaces; and a fluorescent material and a discharge gas, disposed in the discharge spaces.

2. The FFL as claimed in claim 1, wherein the dielectric branches adjoin the patterned dielectric layer above the first strip electrodes.

3. The FFL as claimed in claim 1, wherein the dielectric branches adjoin the patterned dielectric layer above the second strip electrodes.

4. The FFL as claimed in claim 1, wherein the dielectric branches on both sides of each electrode branch are parallel to each other.

5. The FFL as claimed in claim 1, wherein a plurality of discharge areas is formed between the electrode branches of each first strip electrode and the opposite second strip electrode, and the dielectric branches are disposed along the edges of the discharge areas.

6. The FFL as claimed in claim 1, wherein a part of the fluorescent material is distributed on both side walls of each dielectric branch.

7. The FFL as claimed in claim 6, wherein a side of each dielectric branch far away from the electrode branch acquires more fluorescent material than the other side close to the electrode branch.

8. The FFL as claimed in claim 1, wherein the patterned dielectric layer above each second strip electrode has a plurality of recesses.

9. The FFL as claimed in claim 8, wherein the recesses in each discharge space are opposite to the electrode branches, and each recess is located between two adjacent dielectric branches.

10. The FFL as claimed in claim 8, wherein a part of the fluorescent material is distributed in the recesses, and between the patterned dielectric layer above each second strip electrode and the adjacent spacer.

11. The FFL as claimed in claim 1, further comprising a reflecting layer disposed above the first substrate and under the electrode sets.

12. A liquid crystal display (LCD), comprising:

a liquid crystal panel;

an FFL, disposed under the liquid crystal panel, for providing the backlight source required by the liquid crystal panel, the FFL comprising:

a first substrate;

a plurality of electrode sets, disposed on the first substrate, wherein each electrode set comprises at least a first strip electrode and a second strip electrode parallel to each other, and the side edge of the first strip electrode has a plurality of electrode branches extending towards the second strip electrode;

a patterned dielectric layer, disposed on the first substrate and covering the electrode sets;

a plurality of dielectric branches, disposed on the first substrate, and located around the electrode branches;

a second substrate, disposed opposite to the first substrate;

a plurality of spacers, connecting the first substrate and the second substrate, for forming a plurality of discharge spaces between the first substrate and the second substrate, wherein the electrode sets are respectively disposed in the discharge spaces; and a fluorescent material and a discharge gas, disposed in the discharge spaces.

13. The LCD as claimed in claim 12, wherein the dielectric branches adjoin the patterned dielectric layer above the first strip electrodes.

14. The LCD as claimed in claim 12, wherein the dielectric branches adjoin the patterned dielectric layer above the second strip electrodes.

15. The LCD as claimed in claim 12, wherein the dielectric branches on both sides of each electrode branch are parallel to each other.

16. The LCD as claimed in claim 12, wherein a plurality of discharge areas is formed between the electrode branches of each first strip electrode and the opposite second strip electrode, and the dielectric branches are disposed along the edges of the discharge areas.

17. The LCD as claimed in claim 12, wherein a part of the fluorescent material is distributed on both side walls of each dielectric branch.

18. The LCD as claimed in claim 17, wherein a side of each dielectric branch far away from the electrode branch acquires more fluorescent material than the other side close to the electrode branch.

19. The LCD as claimed in claim 12, wherein the patterned dielectric layer above each second strip electrode has a plurality of recesses.

20. The LCD as claimed in claim 19, wherein the recesses in each discharge space are opposite to the electrode branches, and each recess is located between two adjacent dielectric branches.

21. The LCD as claimed in claim 19, wherein a part of the fluorescent material is distributed in the recesses, and between the patterned dielectric layer above each second strip electrode and the adjacent spacer.

22. The LCD as claimed in claim 12, wherein the CCFL further comprises a reflecting layer disposed above the first substrate and under the electrode sets.

* * * * *